US007341315B2

(12) United States Patent
Scheffe et al.

(10) Patent No.: US 7,341,315 B2
(45) Date of Patent: Mar. 11, 2008

(54) DEVICE FOR THE REMOVAL OF COVERINGS LAID ON FLAT SURFACES

(75) Inventors: Willi Scheffe, Cleebronn (DE); Dieter Hammel, Nussdorf (DE)

(73) Assignee: Uzin Utz AG, Ulm (DE)

( * ) Notice: Subject to any disclaimer, the term of this patent is extended or adjusted under 35 U.S.C. 154(b) by 0 days.

(21) Appl. No.: 10/551,546

(22) PCT Filed: Dec. 1, 2004

(86) PCT No.: PCT/EP2004/013650

§ 371 (c)(1),
(2), (4) Date: Jul. 12, 2006

(87) PCT Pub. No.: WO2005/054605

PCT Pub. Date: Jun. 16, 2005

(65) Prior Publication Data

US 2007/0007814 A1 Jan. 11, 2007

(30) Foreign Application Priority Data

Dec. 5, 2003 (DE) ..... 103 57 327

(51) Int. Cl.
*B32B 31/18* (2006.01)

(52) U.S. Cl. ..... 299/37.1; 30/170; 15/93.1; 180/209

(58) Field of Classification Search ..... 299/36.1, 299/37.1; 30/170; 15/93.1; 180/209; 280/9; 81/45

See application file for complete search history.

(56) References Cited

U.S. PATENT DOCUMENTS

| | | | | |
|---|---|---|---|---|
| 4,880,491 | A | 11/1989 | Jacobs et al. | |
| 5,082,330 | A | 1/1992 | Holder | |
| 5,098,165 | A * | 3/1992 | Jacobs et al. | 299/37.1 |
| 6,135,566 | A | 10/2000 | Anderson | |
| 6,299,257 | B1 | 10/2001 | Constantino | |

FOREIGN PATENT DOCUMENTS

| | | |
|---|---|---|
| DE | 7618703 | 11/1976 |
| DE | 9112551 | 4/1992 |

OTHER PUBLICATIONS

International Search Report dated Mar. 21, 2005.

* cited by examiner

*Primary Examiner*—Sunil Singh
(74) *Attorney, Agent, or Firm*—Jenkins, Wilson, Taylor & Hunt, P.A.

(57) ABSTRACT

The invention relates to an apparatus for removing coverings laid on even surfaces, comprising a support frame (10) for mounting driving wheels (16) and for accommodating a motor (17) and a gear (18) for driving the driving wheels (16), and comprising a motor-driven separating knife (25). According to the invention it is provided that at least one loosely rotatable support element (21) is arranged on the support frame (11) parallel to the driving wheels (16).

9 Claims, 3 Drawing Sheets

DEVICE FOR THE REMOVAL OF COVERINGS LAID ON FLAT SURFACES

TECHNICAL FIELD

The invention relates to an apparatus for removing coverings laid on even surfaces, comprising a support frame for mounting driving wheels and for accommodating a motor and a gear for driving the driving wheels, and comprising a motor-driven separating knife.

BACKGROUND ART

Coverings laid on even surfaces, such as carpet coverings laid on floors, are, once they are laid, glued to their bearing surface. This prevents that the coverings get out of place or are displaced when being walked or driven on. If such coverings are to be replaced by new coverings as a result of wear or damage, the old coverings have to be removed first.

Apparatus allowing the removal of such old coverings piece by piece or width by width are already known, whereby a motor-driven, swinging separating knife is pushed between the covering and the even bearing surface. These known apparatus are very bulky and can be handled by the user only with an enormous expenditure of force and difficulty.

Such an apparatus for removing floor coverings is known from the German Utility Model Document DE 76 18 703.6. A motor and a gear for driving the separating knife are arranged on a frame with a handle for moving the apparatus forward. Two guiding wheels are provided opposite the separating knife, which facilitate the guidance and the forward movement of the apparatus when removing a floor covering.

An apparatus for lifting off a floor covering is described in the U.S. Pat. No. 4,394,052, wherein an electromotor and a hydraulic cylinder for driving a separating knife and a means for winding up the lifted off floor covering are provided on a frame. This apparatus has a very massive structure and is cumbersome to handle.

The invention is based on the object to provide a generic apparatus the construction of which is simple and neat, and which allows an energy-saving and comfortable handling.

SUMMARY OF THE INVENTION

According to the invention this is achieved with an apparatus for removing coverings laid on even surfaces having a support frame for mounting driving wheels and for accommodating a motor and a gear for driving the driving wheels. The apparatus also has a motor-driven separating knife. The invention is characterized in that at least one loosely rotatable support element is arranged on the support frame parallel to the driving wheels.

This measure has the great advantage that, at the end of a detached piece or a detached width of a covering, the apparatus can be supported by tilting it onto the loosely rotatable support element which is pressed onto the bearing surface. By this, the driving wheels are lifted off the bearing surface. As a result, the backward movement of the apparatus to the new place of operation can be accomplished easily and without any difficulties because the driving wheels no longer have contact with the bearing surface and a forward movement of the apparatus is prevented. The driving wheels can either continue to rotate during the backward movement of the apparatus—i.e. they need not be switched over with respect to their direction of rotation, which goes easy on and facilitates the electric system of the apparatus—or their drive may be switched off during the backward movement of the apparatus by means of a suitable ON and OFF switch. When tilting the apparatus back into its working position the driving wheels regain contact with the bearing surface and drive the apparatus again in the forward direction.

Advantageous embodiments of the invention are defined in the dependent claims.

In detail, the support element may be arranged behind the driving wheels in the direction of the forward movement of the apparatus. It may be designed as a single broad support roller arranged centrally to the driving wheels. Alternatively, the support element may be designed in the form of at least two support wheels and arranged, if necessary, in the area behind the driving wheels. A broad support roller or, respectively, support wheels arranged with a distance to each other provide the apparatus with a secure stability when the apparatus is tilted onto the support roller or the support wheels for lifting off the driving wheels and the separating knife.

For tilting the apparatus it is an advantage if at least one guide handle is provided at the upper end of the support frame above the support element.

The whole construction of the apparatus may be such that the support frame is formed of two legs arranged with a distance between each other, which preferably have the same shape and size, wherein the legs may come together at their upper end to form a guide handle. According to a preferred embodiment the driving wheels are mounted at the other end of the legs.

The driving motor and the gear for driving the driving wheels may be accommodated on the support frame above the driving wheels, e.g. between the legs forming the support frame. The arrangement of the individual components may be selected such that the gear is arranged directly above the driving wheels.

According to a preferred embodiment a supporting plate is provided in the area of each driving wheel. Each supporting plate comprises at least two pins arranged at the same distance toward the center of the axis of the driving wheels and engaging into oblong holes formed in the support frame and having the shape of the segment of a circle.

The invention will be described in more detail by means of an embodiment illustrated in the drawing.

DETAILED DESCRIPTION OF INVENTION

Figure 2:
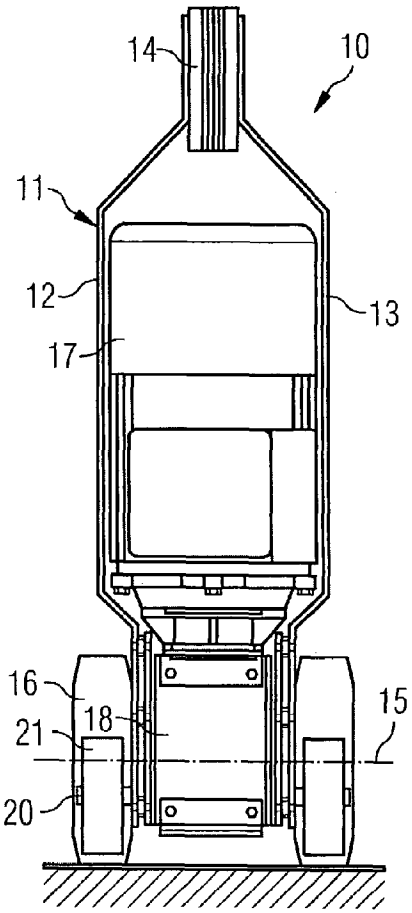
FIG. 2 shows the apparatus according to FIG. 1 in a schematic section not true to scale in a view in the direction of arrow A of FIG. 1.
Figure 1:
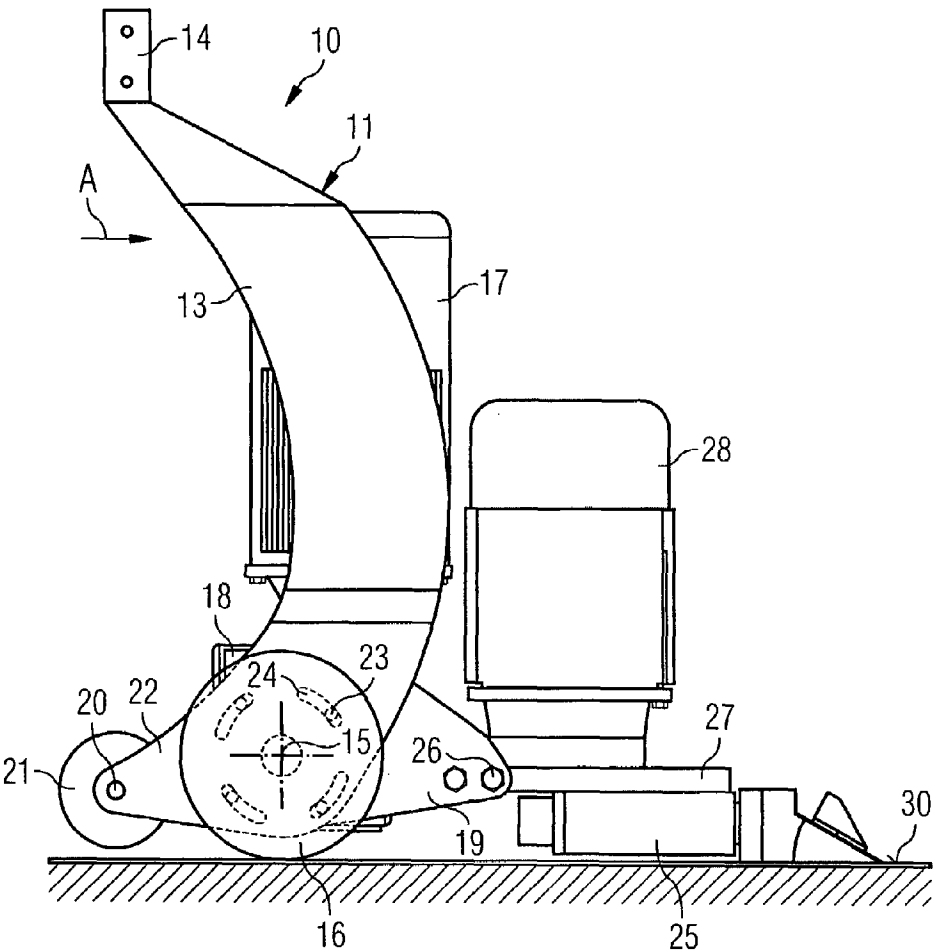
FIG. 1 shows a lateral view of an embodiment of the apparatus according to the invention in an working position in a schematic section not true to scale.

The drawing depicts an embodiment of an apparatus 10 for lifting off coverings from even surfaces, especially floor coverings from floors. The apparatus 10 comprises a support frame 11 formed of two legs 12, 13 of the same shape and size, which are arranged in parallel and with a distance between each other. The legs 12 and 13 come together at their upper end to form a guide handle 14, on which the apparatus 10 is held and guided during its operation. At the lower end of the legs 12, 13 driving wheels 16 are mounted about an axis 15 provided in the same, which drive the apparatus 10 in a forward movement for lifting off a covering.

For driving the driving wheels 16 a motor 17 and a gear 18 are provided, wherein the gear 18 carrying the motor 17 is firmly connected with the legs 12, 13 by means of a supporting plate 19 arranged on both sides of the same.

Seen in the forward movement of the apparatus 10, two support wheels 21 loosely rotatable about an axis 20 and acting as support element are provided behind the driving wheels 16 on a cantilever arm 22 formed on the legs 12, 13. The task and the action of these support wheels is described below.

Moreover according to the embodiment, four pins 23 arranged centrically and with the same angular distance about the axis 15 are provided on the supporting plate 19, which engage into corresponding oblong holes 24 incorporated in the legs 12, 13 and having the shape of the segment of a circle. On the side of the axis 15 opposite the support wheels 21 a separating knife 25 is fixed in an articulated manner with a mounting plate 27 to the supporting plate 19 by means of screws 26. A driving motor 28 for the separating knife 25 is arranged on the supporting plate 19, which brings the separating knife 25 into an intermittent swinging movement for lifting off the covering.

It can be recognized in the embodiment shown in the drawing that the two driving wheels 16 are sitting on the bearing surface 30 in the working position of the apparatus 10 and drive the apparatus 10 forward due to the friction with the ground so as to lift a covering off the bearing surface 30. The separating knife 25 thereby lies on the bearing surface 30 with its blade allowing it to operate between the covering and the bearing surface 30. In this working position, the support wheels 21 are suspended in the air above the bearing surface 30.

Figure 4:
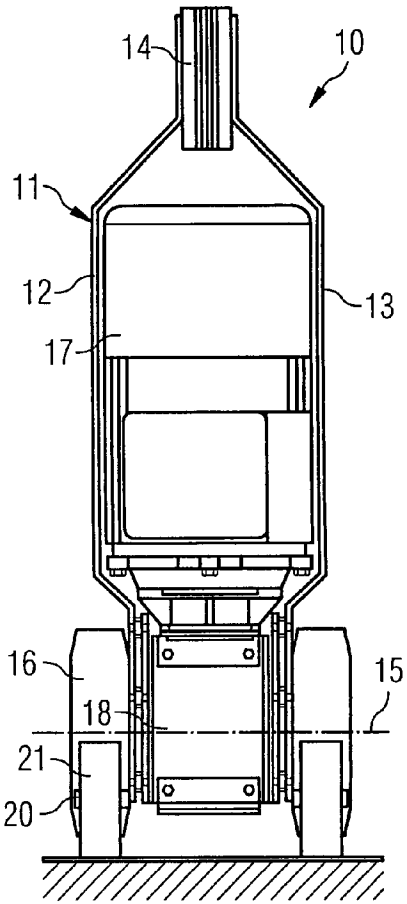
FIG. 4 shows the apparatus according to FIG. 3 in a schematic section not true to scale in a view in the direction of arrow B of FIG. 3.
Figure 3:
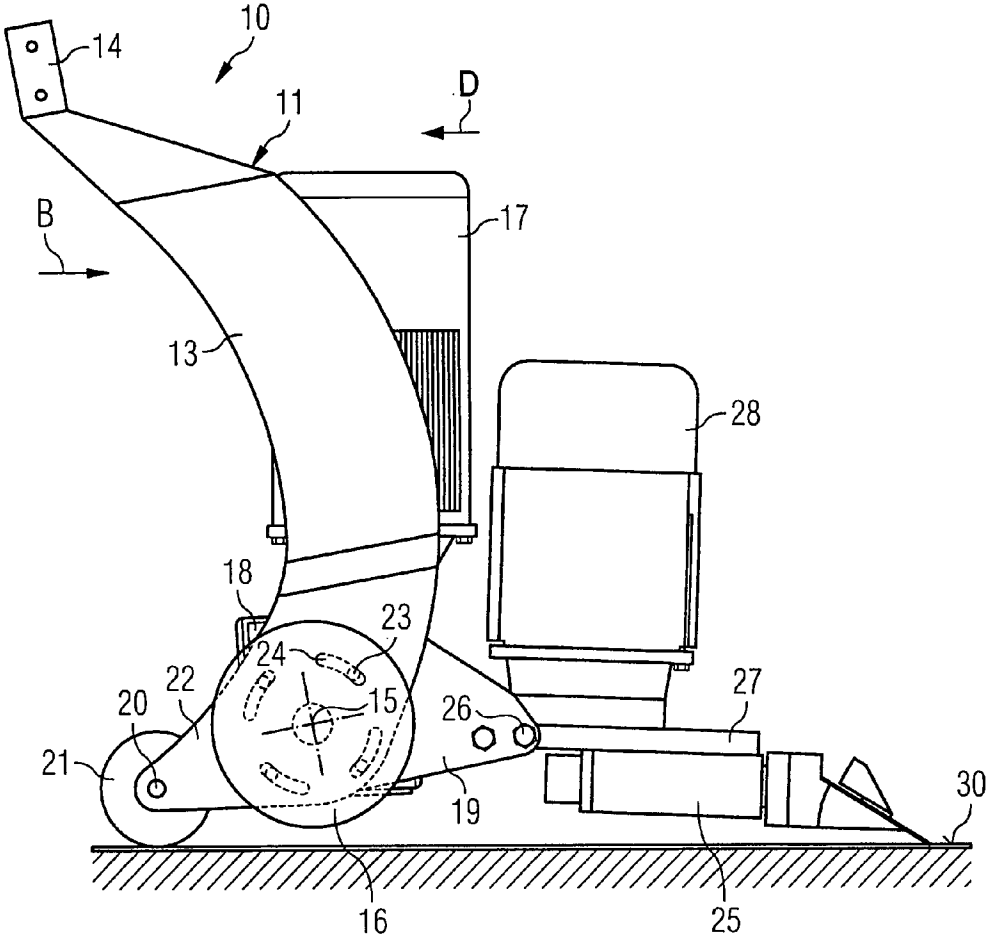
FIG. 3 shows a lateral view of the apparatus according to FIG. 1 in an inoperative position in a schematic section not true to scale.
Figure 5:
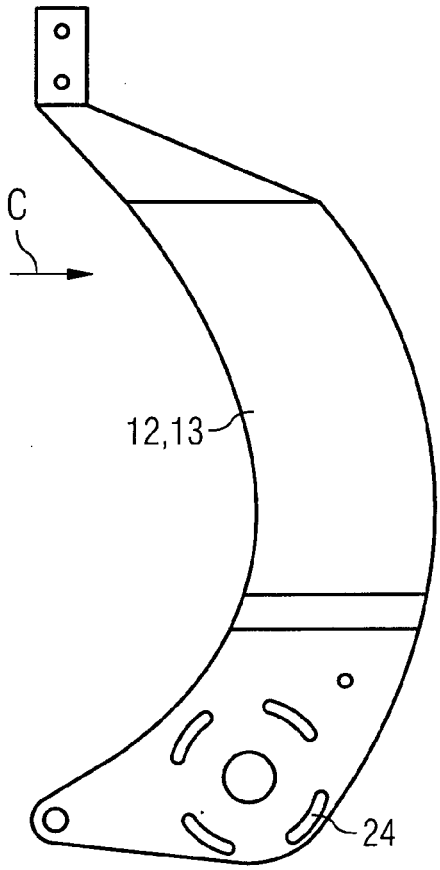
FIG. 5 shows a lateral view of a support frame in the form of a leg in a schematic section not true to scale.
Figure 6:
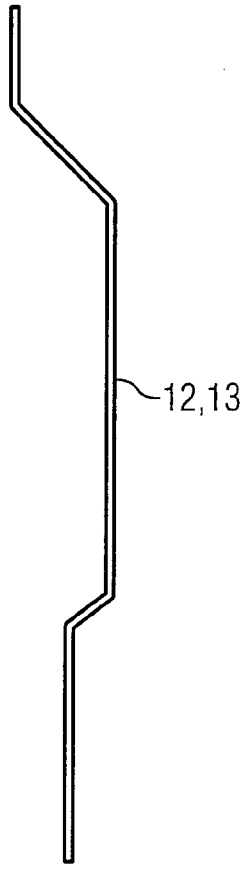
FIG. 6 shows the leg according to FIG. 5 in a schematic section not true to scale in a view in the direction of arrow C of FIG. 5.
Figure 7:
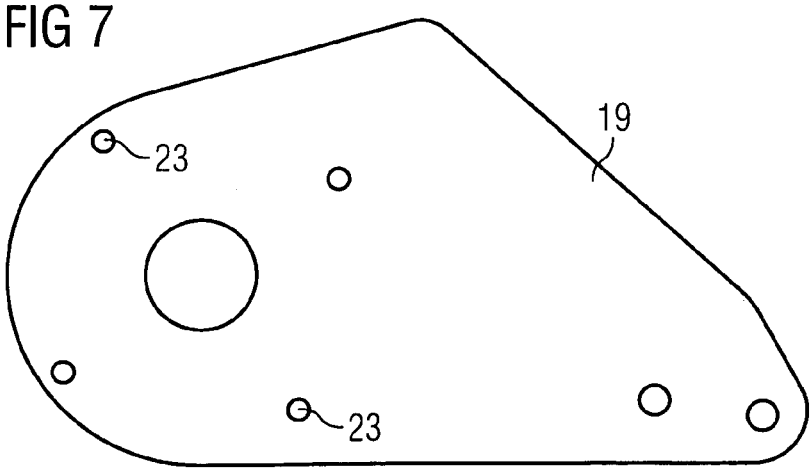
FIG. 7 shows a lateral view of the supporting plate of the apparatus according to FIG. 1 in a schematic section not true to scale.

After a piece or a width of the covering has been lifted off, the apparatus 10 has to be moved back to a new place of operation. Therefore, prior to the backward movement, the apparatus 10 can be placed onto the support wheels 21 by tilting it in the direction of the arrow D, whereby the driving wheels 16 are lifted off the bearing surface 30 (compare FIGS. 3 and 4). During this process the pins 23 run against an end of the oblong holes 24, so that the driving wheels 16 and the separating knife 25 are suspended in the legs 12, 13. Now, the apparatus 10 may be pulled backwards to the new place of operation in a comfortable backward movement, while the motor 17 and also the driving motor 28 continue to run without disturbing the backward movement of the apparatus 10.

The invention claimed is:

1. An apparatus for removing coverings laid on even surfaces, comprising:

(a) a support frame for mounting driving wheels about a rotational axis and for accommodating a motor and a gear for driving the driving wheels in a working direction, (b) at least one support element arranged behind the driving wheels in the working direction, (c) a motor-driven separating knife, wherein for the movement of the apparatus opposite to the working direction the driving wheels are arranged for lifting off by tilting the support frame onto the at least one support element, and (d) supporting plates each being provided in the area of a respective driving wheel and being relatively movable to the support frame, wherein the motor-driven separating knife is fixed on the supporting plates and wherein each supporting plate comprises at least two pins arranged at the same distance toward the center of the axis of the driving wheels and engaging oblong holes formed in the support frame and having the shape of the segment of a circle for limiting the relative movement between the support frame and the supporting plates.

2. The apparatus according to claim 1, wherein at least one guide handle for tilting the support frame is provided on the support frame above the at least one support element.

3. The apparatus according to claim 1, wherein the at least one support element comprises a loosely rotatable support roller arranged centrally and parallel to the rotational axis of the driving wheels in the working direction.

4. The apparatus according to claim 1, wherein the at least one support element comprises two loosely rotatable support wheels the axes of which are arranged parallel to the rotational axis of the driving wheels.

5. The apparatus according to claim 1, wherein the gear is arranged between the supporting plates.

6. The apparatus according to claim 1, wherein the driving motor for the driving wheels is arranged on the gear.

7. The apparatus according to claim 1, wherein the separating knife is fixed on a mounting plate which is mounted to the supporting plates and on which a driving motor for the separating knife is arranged.

8. The apparatus according to claim 1, wherein a drive with an intermittent pivoting movement is provided for the separating knife.

9. The apparatus according to claim 1, wherein the support frame comprises two legs arranged with a distance between each other, each of which comprising a cantilever arm for mounting the at least one support element.

* * * * *